US005358108A

United States Patent [19]

Celaya

[11] Patent Number: 5,358,108

[45] Date of Patent: Oct. 25, 1994

[54] ARROW STORAGE CONTAINER

[76] Inventor: Joseph R. Celaya, 1339 W. Nopal Ave., Mesa, Ariz. 85202

[21] Appl. No.: 186,993

[22] Filed: Jan. 27, 1994

[51] Int. Cl.[5] ..... B65D 85/20

[52] U.S. Cl. ..... 206/315.11; 224/916

[58] Field of Search ..... 206/315.11; 224/916

[56] References Cited

U.S. PATENT DOCUMENTS

| | | | |
|---|---|---|---|
| 3,088,583 | 5/1963 | Holtz | 224/916 |
| 3,301,386 | 1/1967 | Carter | 206/315.11 |
| 3,337,028 | 8/1967 | Glavan | 206/315.11 |
| 3,465,928 | 9/1969 | Osterholm | 224/916 |
| 3,563,549 | 2/1971 | Dragone et al. . | |
| 3,896,782 | 7/1975 | Carella . | |
| 4,621,606 | 11/1986 | Toth . | |
| 4,643,302 | 2/1987 | Baumgardner | 206/315.11 |
| 4,955,473 | 9/1990 | Van Hout et al. | 206/315.11 |
| 5,011,028 | 4/1991 | Sweeney . | |
| 5,085,319 | 2/1992 | Wellman et al. . | |
| 5,242,050 | 9/1993 | Billings | 206/315.11 |

*Primary Examiner*—William I. Price

[57] ABSTRACT

A container to provide for the storage of arrows in a parallel relationship is provided to afford protection to the arrows prior to use. Individual parallel tubes are mounted rigidly within a container structure to individually receive arrows therewithin. The container helps protect the delicate fletching of the arrows during their storage.

4 Claims, 4 Drawing Sheets

ARROW STORAGE CONTAINER

BACKGROUND OF THE INVENTION

1. Field of the Invention

The field of invention relates to arrow storage structure, and more particularly pertains to a new arrow storage container wherein the same is arranged for the mounting of arrows within a rigid container structure.

2. Description of the Prior Art

Arrow holders of various types are indicated in the prior art and exemplified by the U.S. Pat. Nos. 5,011,028; 3,563,549; 5,085,319; 3,896,782; and 4,621,606.

The instant invention attempts to overcome deficiencies of the prior art by providing for a container arranged to store and secure arrows during their transport without damaging the delicate retching forming a part thereof and, in this respect, the present invention substantially fulfills this need.

SUMMARY OF THE INVENTION

In view of the disadvantages inherent in the known types of arrow storage apparatus now present in the prior art, the present invention provides an arrow storage container wherein the same is arranged to include a plurality of spaced parallel tubes to store arrows therewithin. As such, the general purpose of the present invention, which will be described subsequently in greater detail, is to provide a new arrow storage container apparatus and method which has many of the advantages of the prior art listed heretofore and many novel features that result in a arrow storage container which is not anticipated, rendered obvious, suggested, or even implied by any of the prior art, either alone or in any combination thereof.

To attain this, the present invention provides a container for the storage of arrows in a parallel relationship to afford protection to the arrows prior to use. Individual parallel tubes are mounted rigidly within a container structure to individually receive arrows therewithin. The container helps protect the delicate fletching of the arrows during their storage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new arrow storage container apparatus and method which has many of the advantages of the prior art listed heretofore and many novel features that result in a arrow storage container which is not anticipated, rendered obvious, suggested, or even implied by any of the prior art, either alone or in any combination thereof.

It is another object of the present invention to provide a new arrow storage container which may be easily and efficiently manufactured and marketed.

It is a further object of the present invention to provide a new arrow storage container which is of a durable and reliable construction.

An even further object of the present invention is to provide a new arrow storage container which is susceptible of a low cost of manufacture with regard to both materials and labor, and which accordingly is then susceptible of low prices of sale to the consuming public, thereby making such arrow storage containers economically available to the buying public.

Still yet another object of the present invention is to provide a new arrow storage container which provides in the apparatuses and methods of the prior art some of the advantages thereof, while simultaneously overcoming some of the disadvantages normally associated therewith.

It is a further object of the present invention to provide a new arrow storage container comprising individual parallel tubes mounted rigidly within a container structure to individually receive arrows therewithin and to protect the delicate retching of the arrows during their storage.

It is yet still a further object of the present invention to provide a new arrow storage container including resilient inserts each having a central bore with a plurality of radial slots extending from the central bore to an outer periphery thereof to maintain alignment and absorb vibration directed to the container during transport and use.

It is even a further object of the present invention to provide a new arrow storage container including a plurality of storage tubes wherein each lowermost end of the storage tubes is formed with a lubricant and/or rust-preventative impregnated fibrous conical receptacle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
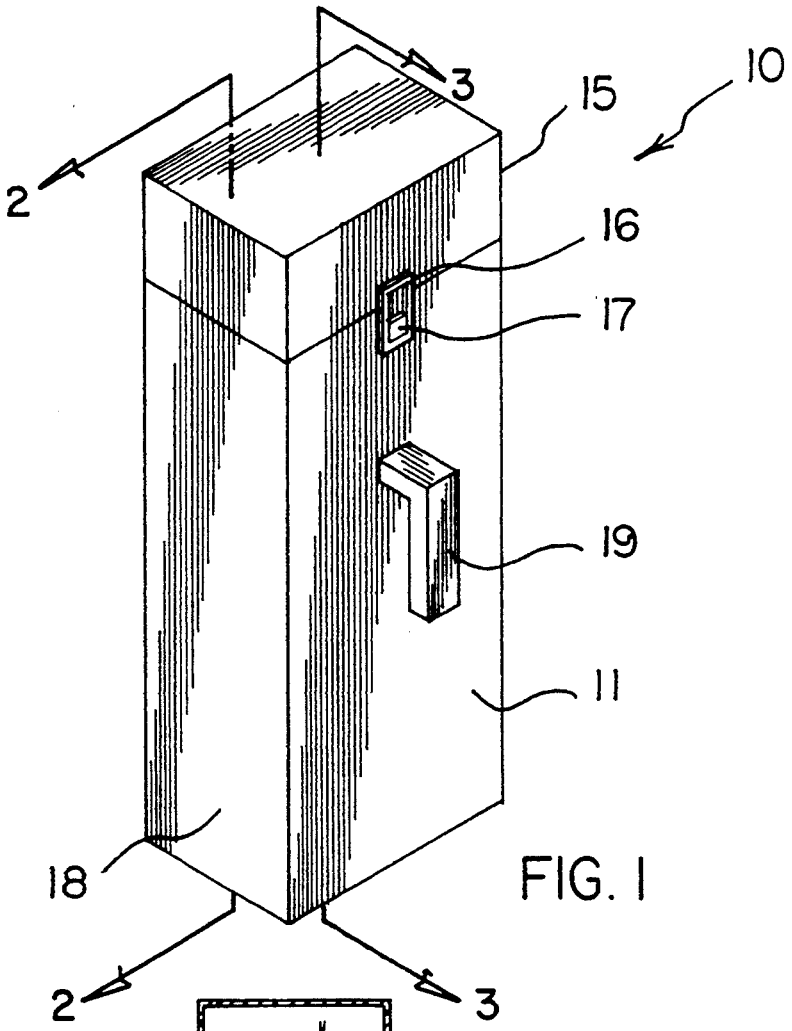
FIG. 1 is an isometric illustration of the invention.
Figure 2:
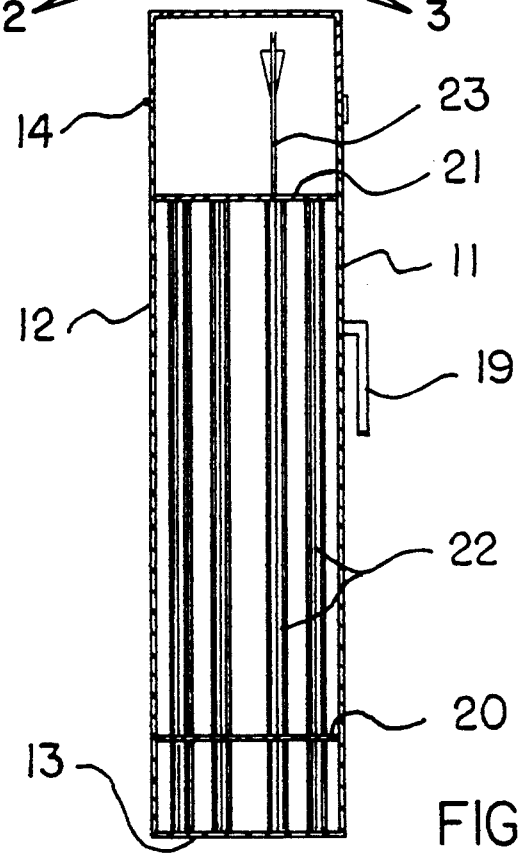
FIG. 2 is a cross sectional view, taken along the lines 2—2 of FIG. 1 in the direction indicated by the arrows.

With reference now to the drawings, and in particular to FIGS. 1-10 thereof, a new arrow storage container embodying the principles and concepts of the present invention and generally designated by the reference numeral 10 will be described.

Figure 6:
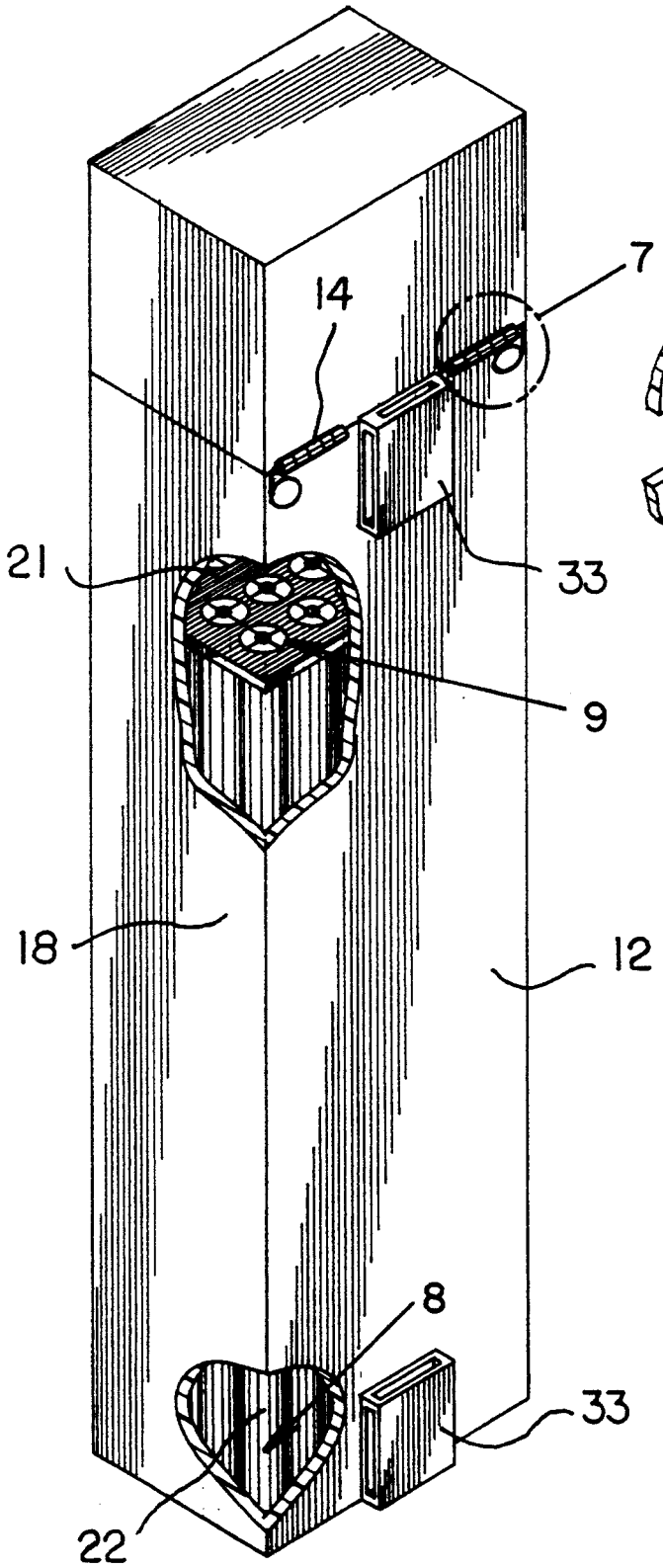
FIG. 6 is an isometric illustration, partially in cross section, of the container indicating a rear view thereof.

More specifically, the arrow storage container 10 of the instant invention comprises a rigid container having a front wall 11, a rear wall 12, a bottom wall 13, and spaced side walls 18 to define a substantially rectangularly-shaped parallelepiped container. At least one hinge and preferably a plurality of hinges 14 (see FIG. 6) are mounted to an uppermost end of the rear wall 12. The hinge or hinges 14 mounts a lid 15 onto an upper periphery defined by the combination of the front wall 11, the rear wall 12, and the side walls 18. The lid 15 includes a latch 16 arranged for securement to a lid lug 17 mounted to the front wall 11. A handle 19, of a generally L-shaped configuration, is integral with the front wall 11 for ease of transport of the structure. In addition and as illustrated in FIG. 6, belt loops 33 may be positioned to upper and lowermost ends of the rear wall to permit securement to a belt structure.

Figure 3:
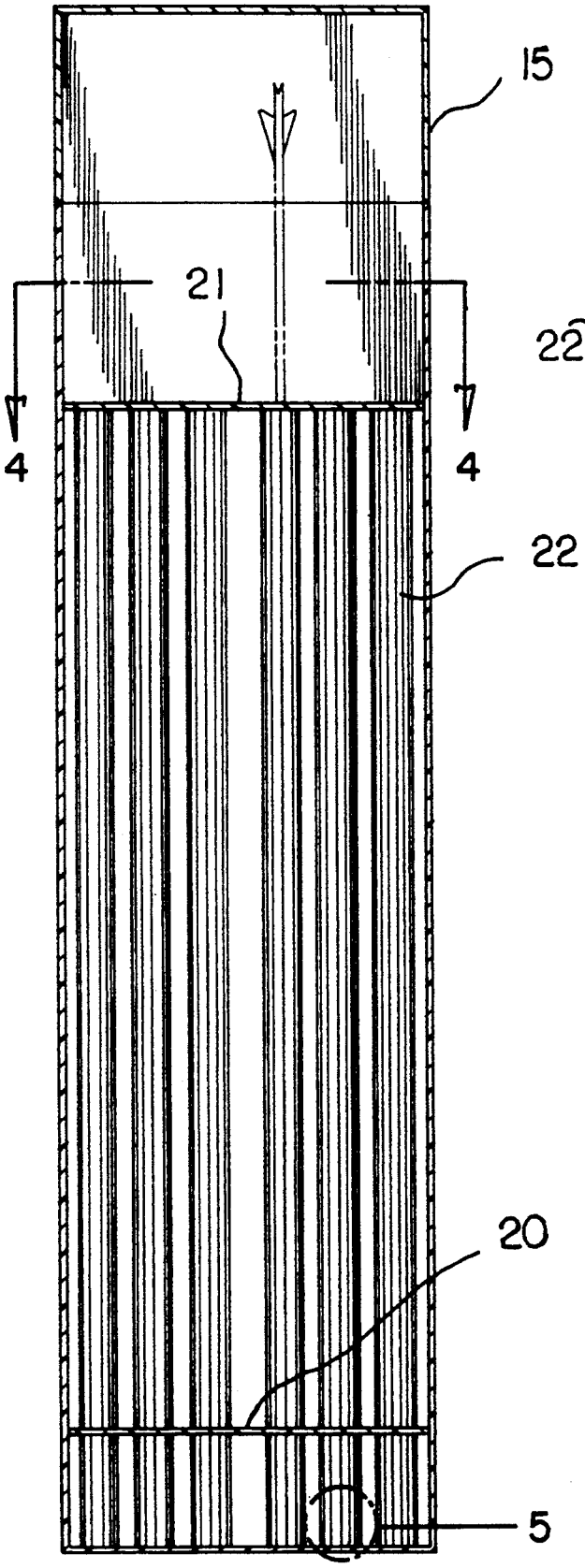
FIG. 3 is a further cross sectional view, taken along the lines 3—3 of FIG. 1 in the direction indicated by the arrows.
Figure 4:
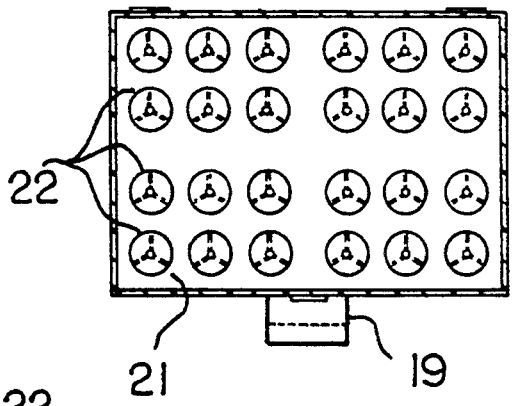
FIG. 4 is a even further cross sectional view, taken along the lines FIG. 3 in the direction indicated by the arrows.
Figure 5:
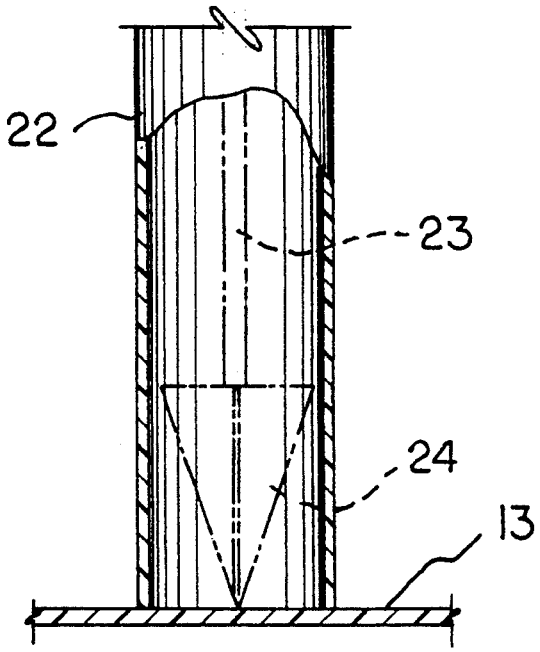
FIG. 5 is an enlarged cross sectional illustration of section 5 as set forth in FIG. 3.
Figure 8:
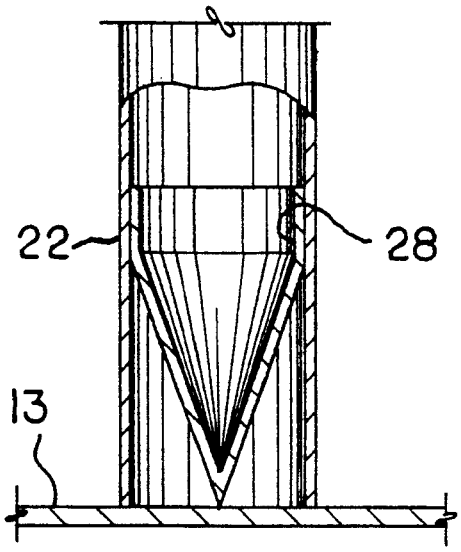
FIG. 8 is a cross sectional illustration of the area set forth in FIG. 6.

To accommodate an organized arrangement of arrows within the container 10, a first web 20 is fixedly mounted within the container parallel to and coextensive the bottom wall 13, as best illustrated in FIG. 3. A second web 21 is similarly fixedly mounted within the container parallel to the first web 20, with the second web arranged in a spaced orientation between the lid 15 and the first web. The first and second webs 20, 21 orthogonally and integrally mount therethrough a matrix of storage tubes 22 of rigid construction. Each of the storage tubes 22 is dimensioned to receive a conventional arrow shaft 23 therewithin. Typically, each arrow shaft 23 is formed with a conventional arrow head 24, as illustrated in FIG. 5 in phantom. The arrow head 24 may simply rest against the interior surface of the bottom wall 13 as shown, or the container may be provided with a conical receptacle 28. FIG. 8 illustrates the variation of the invention wherein each lowermost end of the storage tubes 22 is formed with a lubricant impregnated fibrous conical receptacle 28. In this manner, the arrows are maintained in a clean operative condition prior to use. In addition, the lubricant may include a rust-preventative for precluding corrosion of sharpened arrowhead in which bare metal is typically exposed.

Figure 7:
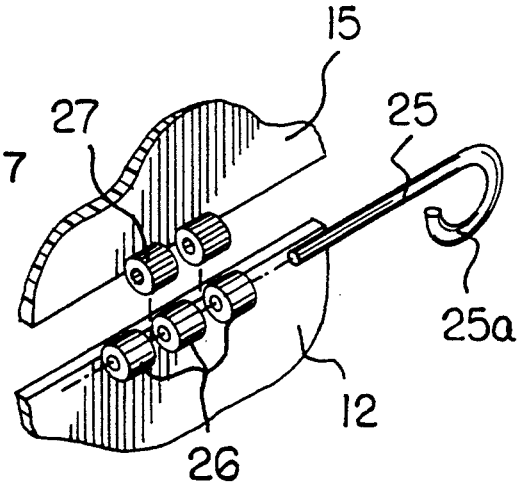
FIG. 7 is an isometric exploded illustration of portion of the invention as indicated by the circled area in FIG. 6.

With reference to FIG. 7, it can be shown that the hinge 14 is constructed of a plurality first hinge cylinders 26 fixedly mounted to the rear wall 12, and a plurality of second hinge cylinders 27 mounted to the lid 15, with each of the second hinge cylinders 27 mounted between spaced first hinge cylinders 26. When the first and second hinge cylinders 26 and 27 are aligned, a slide pin 25 is received through the first and second hinge cylinders 26 and 27. The slide pin 25 is formed with a handle loop 25*a* at an end of the slide pin for ease of manual grasping and removal of the slide pin to provide ease of access within the structure.

Figure 9:
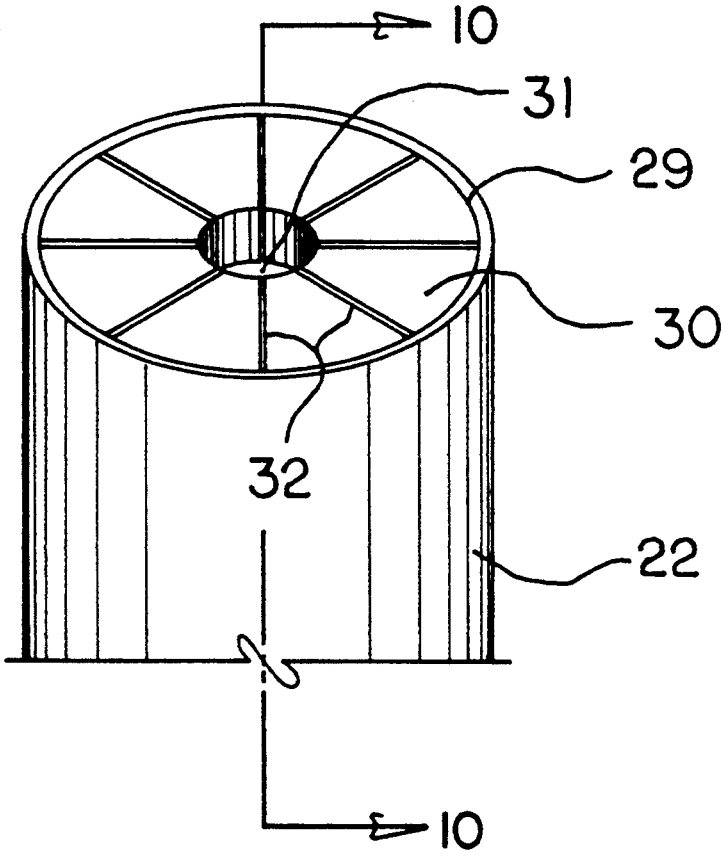
FIG. 9 is an enlarged isometric illustration of the area labeled 9 as indicated in FIG. 6.
Figure 10:
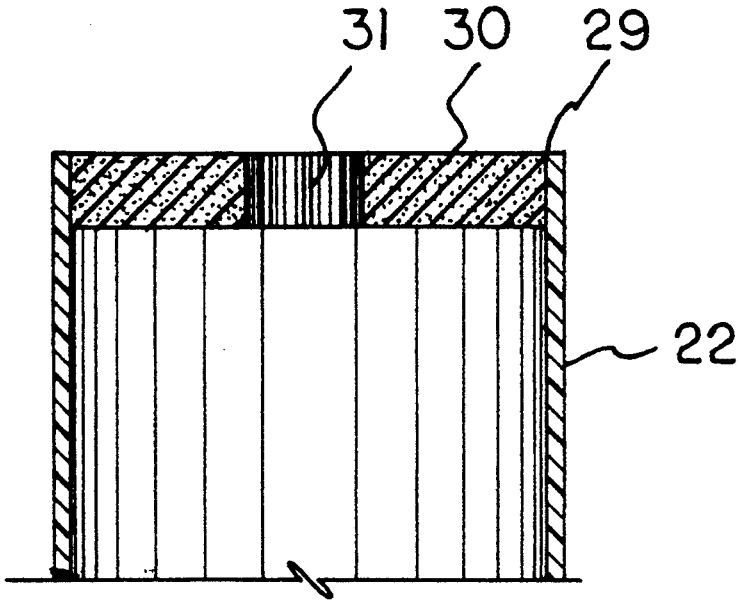
FIG. 10 is a cross sectional view, taken along the lines 10—10 of FIG. 9 in the direction indicated by the arrows.

As best illustrated in FIGS. 9 and 10, the upper distal end of each of the storage tubes 22 is formed with a resilient insert 30 having a central bore 31 with a plurality of radial slots 32 extending from the central bore 31 to an outer periphery of the web insert 30 to maintain alignment and accommodate vibration directed to the container during transport and use. The slots 32 allow various arrowheads, such as the arrowhead 24 illustrated in FIG. 5, to pass through the insert 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An arrow storage container, comprising:

a substantially rectangular rigid housing having a front wall coextensive to a rear wall, a bottom wall orthogonally mounted to the front wall and the rear wall, and spaced side walls fixedly and orthogonally mounted to the bottom wall, the front wall, and the rear wall, with the front wall, the rear wall, the side walls cooperating to define an uppermost periphery parallel to the bottom wall;

at least one hinge mounted to the uppermost periphery at the rear wall;

a lid secured to the hinge;

latch means mounted to the lid for securing the lid to the periphery;

a first web fixedly and integrally mounted within the housing to the front wall, the rear wall, and the side walls, with the first web being parallel to and coextensive with the bottom wall;

a second web fixedly mounted within the housing to the front wall, the rear wall, and the side walls and positioned between the uppermost periphery and the first web and arranged in a parallel coextensive relationship relative to the first web; and a matrix of rigid storage tubes orthogonally directed through the first web and the second web and fixedly secured to the bottom wall, with each of the tubes having an uppermost end arranged to receive an arrow therethrough.

2. The container as set forth in claim 1, wherein the hinge includes a plurality of axially aligned first hinge cylinders fixedly mounted to the rear wall at the uppermost periphery; a plurality of axially aligned second hinge cylinders mounted to the lid, with one of said second hinge cylinders oriented between and in alignment with the plurality of axially aligned first hinge cylinders; and a slide pin slidably directed through the first hinge cylinders and the second hinge cylinders, the slide pin having a handle loop at an outermost end portion of the slide pin for ease of manual manipulation of the slide pin relative to the first hinge cylinders and the second hinge cylinders.

3. The container as set forth in claim 2, wherein each of the storage tubes includes a lubricant impregnated fibrous conical receptacle fixedly mounted adjacent the bottom wall to receive an arrowhead therewithin said receptacle.

4. A container as set forth in claim 3, wherein each storage tube includes an entrance end in which a resilient web insert is positioned, the resilient web insert including a central bore and a plurality of radial slots extending from the central bore to an outermost periphery of the resilient web insert.

* * * * *